US005485483A

United States Patent [19]

Couffet et al.

[11] Patent Number: 5,485,483

[45] Date of Patent: Jan. 16, 1996

[54] DEVICE FOR PROTECTING AND COOLING THE POLES OF AN ELECTROMAGNETIC INDUCTOR

[75] Inventors: Claude Couffet, Montreuil; Jean Hellegouarc'h, Le Perreux/Marne; Gérard Prost, Fresnes; Jean C. Uring, Colmar, all of France

[73] Assignee: Celes, Lautenbach, France

[21] Appl. No.: 80,258

[22] Filed: Jun. 23, 1993

[30] Foreign Application Priority Data

Jun. 24, 1992 [FR] France ..... 92 07739

[51] Int. Cl.[6] ..... H05B 6/22

[52] U.S. Cl. ..... 373/154; 373/152

[58] Field of Search ..... 373/152, 153, 373/154, 158; 266/242

[56] References Cited

U.S. PATENT DOCUMENTS

| | | | |
|---|---|---|---|
| 2,781,437 | 2/1957 | McArthur | 373/154 |
| 4,339,625 | 7/1982 | Delassus et al. | 373/158 |
| 4,411,412 | 10/1983 | Lechevallier | 373/154 |
| 5,125,004 | 6/1992 | Roberts et al. | 373/143 |

FOREIGN PATENT DOCUMENTS

| | | |
|---|---|---|
| 020215 | 12/1980 | European Pat. Off. . |
| 053070 | 6/1982 | European Pat. Off. . |
| 340057 | 11/1989 | European Pat. Off. . |
| 9106194 | 5/1991 | WIPO . |

*Primary Examiner*—Tu Hoang
*Attorney, Agent, or Firm*—Pollack, Vande Sande & Priddy

[57] ABSTRACT

A device achieves thermal protection and cooling of the poles of an electromagnetic inductor, in particular for an induction furnace. The furnace comprises a plurality of tubes, arranged side by side and substantially coplanar, through which a coolant fluid flows. The connection of the tubes to the inlet and outlet pipes for the coolant fluid is made by a combination of socket and O-rings designed to ensure both electrical discontinuity and leaktightness between each tube and the pipes.

10 Claims, 1 Drawing Sheet

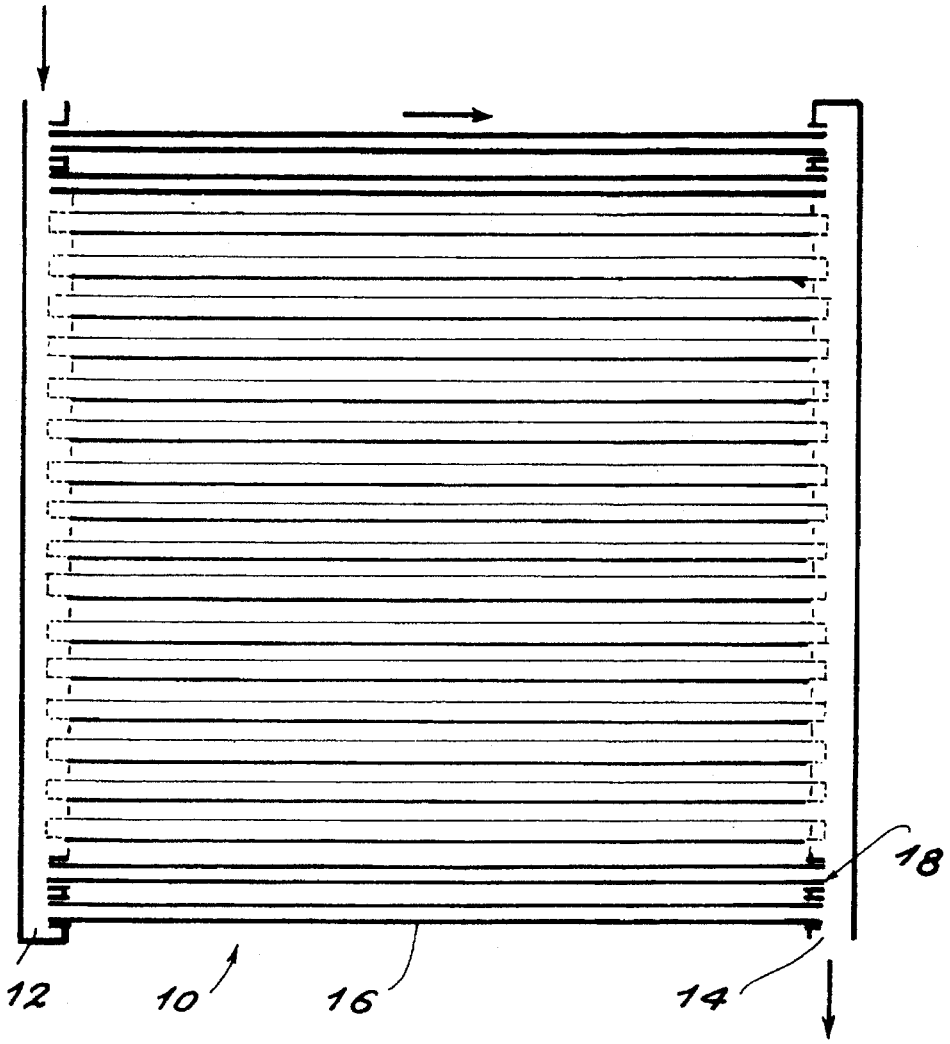
FIG. 1
FIG. 2
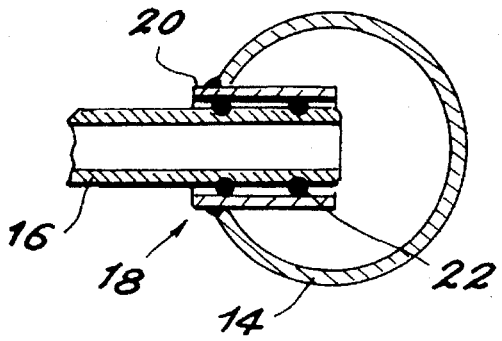

DEVICE FOR PROTECTING AND COOLING THE POLES OF AN ELECTROMAGNETIC INDUCTOR

FIELD OF THE INVENTION

The present invention relates to a device for protecting and cooling the poles of an electromagnetic inductor.

BRIEF DESCRIPTION OF THE PRIOR ART

It is known that, in order to carry out the heat treatment of metallurgical products, induction furnaces are frequently used, which generally comprise a flat inductor which is provided with a thermal protection system, in particular comprising an internal flow of a coolant fluid. In the furnaces of this type currently produced, this thermal protection system is generally constructed in the form of a thermal screen produced by assembling metal tubes, placed side by side, supplied with coolant fluid, and connected to inlet and outlet pipes for the coolant fluid.

The difficulty in producing such a thermal screen is due to the fact that it must not constitute a magnetic screen, that is to say, it must be as transparent as possible to magnetic fields. Now, on this particular point, current solutions are not completely satisfactory and, for this reason, the objective of the present invention is to provide a novel device of the thermal screen type which is improved with respect to current models.

BRIEF DESCRIPTION OF THE INVENTION

The invention therefore relates to a device for thermal protection and cooling of the poles of an electromagnetic inductor, in particular for an induction furnace, of the type consisting of a plurality of tubes, arranged side by side and substantially coplanar, through which a coolant fluid flows. The connection of the tubes to the inlet and outlet pipes for the coolant fluid is made by a means designed so as to ensure both electrical discontinuity and leaktightness between each tube and the said pipes.

According to a preferred embodiment of the device which forms the subject of the invention, the means providing the connection of the tubes to the inlet and outlet pipes for the coolant fluid consist of a socket, welded or brazed onto the pipe, in which the end of the tube emerging in the pipe is engaged, sealing and electrical insulation joints being interposed between the socket and the tube.

According to another embodiment of the invention, the tubes can be made from a magnetic or non-magnetic metal, preferably non-magnetic stainless steel, or from an electrically insulating material.

Other characteristics and advantages of the present invention will emerge from the description which is given below with reference to the attached drawing, which illustrates one entirely non-limiting embodiment thereof. In the drawing:

BRIEF DESCRIPTION OF THE FIGURES

FIG. 1 is a side elevation of a thermal protection screen produced according to the present invention, and, FIG. 2 is a detailed view, on a larger scale, representing the means employed by the invention for providing the linkage between the tubes of the thermal screen and the inlet and outlet pipes for the coolant fluid, this view being a section through a plane which is perpendicular to the axis of a pipe and passes through the axis of the tube in question.

DETAILED DESCRIPTION OF THE INVENTION

In order to simplify the drawing, the structure of the inductor to which the device forming the subject of the invention applies has not been represented. This inductor is a component which is well known to the person skilled in the art, which does not form part of the invention, and is thus not necessary to describe.

Referring to the drawing, and more particularly to FIG. 1, it is seen that the device for protecting the poles of the inductor has the form of a thermal screen, denoted in its entirety by the reference 10, and which consists of a plurality of tubes, such as 16, arranged beside each other in a substantially coplanar configuration. These tubes can be made from a magnetic or non-magnetic material, or alternatively from insulating materials.

According to the invention, the tubes 16 are connected by their ends, respectively, to an inlet pipe 12 for a coolant fluid, for example water, and to a pipe 14, through which the coolant fluid is drained after flowing through the bundle of tubes 16.

It is necessary for the thermal screen 10 thus produced to be transparent to the magnetic field developed by the inductor. For this purpose, the invention affects the linkage or connection between the ends of the tubes 16 and the pipes 12 and 14 in such a way as to ensure both leaktightness to the coolant fluid and electrical insulation between these ends and the pipes.

In FIG. 1, the connection means thus employed has been denoted in its entirety by the reference 18, and FIG. 2 represents it in detail. As this figure shows, in this non-limiting embodiment, this connection means consists of a socket 20, which open at both its ends and is engaged inside one of the pipes, such as 14 or 12, this socket being welded or brazed onto the pipe. Each socket is made so as to receive the end of a tube 16 adjacent the pipe 14 or 12. In order to ensure both leaktightness and electrical insulation between the tube 16 in question and the pipe, such as 14, to which it is thus connected, O-ring made of an insulating material are used as seals 22.

By virtue of this arrangement, the magnetic field is not interrupted by the thermal protection screen according to the invention, which is completely transparent to the magnetic flux. It will be noted that the solution afforded by the invention is particularly simple and inexpensive to produce, is easy to implement, and furthermore, it allows rapid and uncomplicated replacement of one or more of the tubes 16 of the screen 10, which considerably facilitates the maintenance of the inductors thus equipped.

It is evident that the present invention is not limited to the embodiments described and/or represented herein, but encompasses all variants thereof.

We claim:

1. A device for thermally protecting and cooling the poles of an electromagnetic inductor for an induction furnace comprising:

a plurality of tubes positioned in parallel spaced coplanar relation through which cooling fluid flows;

an inlet pipe connected to first ends of the tubes;

an outlet pipe connected to the second ends of the tubes; and means connecting each of said first and second ends of the tubes to the pipes to allow free expansion-contraction of the tubes relative to the pipes, for ensuring electrical isolation and fluid leaktightness therebetween.

2. A device for thermally protecting and cooling the poles of an electromagnetic inductor as set forth in claim 1 wherein the connecting means comprise sockets, brazed at points along the length of the inlet and outlet pipes, for receiving respective ends of tubes; and means interposed between each socket and a respective tube end for concurrently ensuring the electrical isolation and fluid leaktightness between the tubes and the pipes.

3. A device for thermal protection an cooling the poles of an electromagnetic inductor as set forth in claim 2 wherein the interposed means are o-rings.

4. A device for thermally protecting and cooling the poles of an electromagnetic inductor as set forth in claim 1 wherein the tubes are fabricated from magnetic metal.

5. A device for thermally protecting and cooling the poles of an electromagnetic inductor as set forth in claim 1 wherein the tubes are fabricated from non-magnetic stainless steel.

6. A device for thermally protecting and cooling the poles of an electromagnetic inductor as set forth in claim 1 wherein the tubes are fabricated from an electrically insulating material.

7. A device for thermally protecting and cooling the poles of an electromagnetic inductor as set forth in claim 1 wherein the connecting means comprise sockets, welded at points along the length of the inlet and outlet pipes, for receiving respective ends of tubes; and means interposed between each socket and a respective tube end for concurrently ensuring the electrical isolation and fluid leaktightness between the tubes and the pipes.

8. A device for thermally protecting and cooling the poles of an electromagnetic inductor as set forth in claim 7 wherein the tubes are fabricated from non-magnetic stainless steel.

9. A device for thermally protecting and cooling the poles of an electromagnetic inductor as set forth in claim 7 wherein the tubes are fabricated from an electrically insulating material.

10. A device for thermal protection an cooling the poles of an electromagnetic inductor as set forth in claim 7 wherein the interposed means are o-rings.

* * * * *